US007421750B2

(12) United States Patent
Knoff

(10) Patent No.: US 7,421,750 B2
(45) Date of Patent: Sep. 9, 2008

(54) PILLOW-TOP MATTRESS COMPRISING A FIRE BLOCKED GUSSET

(75) Inventor: Warren F. Knoff, Richmond, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 320 days.

(21) Appl. No.: 11/266,713

(22) Filed: Nov. 3, 2005

(65) Prior Publication Data

US 2007/0094804 A1 May 3, 2007

(51) Int. Cl.
*A47C 27/00* (2006.01)

(52) U.S. Cl. ..... 5/698; 5/954

(58) Field of Classification Search ..... 5/698, 5/690, 954

See application file for complete search history.

(56) References Cited

U.S. PATENT DOCUMENTS

| | | | | |
|---|---|---|---|---|
| 3,889,305 | A * | 6/1975 | Goldberg | 5/698 |
| 5,586,511 | A * | 12/1996 | Porter et al. | 112/2.1 |
| 6,823,548 | B2 | 11/2004 | Murphy et al. | |
| 6,954,956 | B1 * | 10/2005 | Diaz | 5/698 |
| 7,225,487 | B2 * | 6/2007 | Small et al. | 5/698 |
| 2002/0144352 | A1 | 10/2002 | Freeman et al. | |
| 2004/0060120 | A1 | 4/2004 | Murphy et al. | |

* cited by examiner

*Primary Examiner*—Alexander Grosz

(57) ABSTRACT

This invention relates to an improved gusset for use in fire-blocking a pillow-top mattress. This gusset provides additional fire blocking to provide a pillow-top mattress with improved performance when tested according to Technical Bulletin 603 of the State of California.

9 Claims, 5 Drawing Sheets

PILLOW-TOP MATTRESS COMPRISING A FIRE BLOCKED GUSSET

BACKGROUND OF THE INVENTION

1. Field of the Invention

This invention relates to an improved gusset for use in fire-blocking a pillow-top mattress. This gusset provides additional fire blocking to provide a pillow-top mattress with improved performance when tested according to Technical Bulletin 603 of the State of California.

2. Description of Prior Art

The State of California has led the drive to regulate and reduce the flammability of mattresses and mattress sets in an attempt to reduce the number of lives lost in household, hotel, and institutional fires. In particular, the Bureau of Home Furnishings and Thermal Insulation of the Department of Consumer Affairs of the State of California issued Technical Bulletin 603 "Requirements and Test Procedure for Resistance of a Residential Mattress/Box Spring Set to a Large Open-Flame" to quantify the flammability performance of mattress sets.

Mattresses are sold by a consumer's initial impression of support and comfort and therefore mattresses normally contain, in addition to any supporting foam or steel springs in the mattress body, surface cushioning material made from light density fibrous battings or foams, or a combination of both, that provide a surface cushioning effect, but can be very flammable.

The mattress design referred to in the industry as a pillow-top mattress has an additional cushion or pillow attached to the mattress core to provide even more cushioning material. In addition, to emphasize the pillow look of the mattress, the pillow is attached to the mattress body inboard of the edge or side border of the mattress body, giving the mattress a true "pillow-top" look. By attaching the cushion or pillow in this manner, the side of the mattress has an area of indention, where the bottom face of the pillow or cushion projects over the mattress body. The joint between the mattress body and the pillow is typically covered with a fabric gusset. The fabric gusset normally extends from the out board upper seam of the mattress body, across the upper surface of the mattress body to the point where the pillow contacts the mattress body, and then up the underside of the pillow surface to the outboard edge of the pillow.

This additional surface area of the gusset creates a major problem in passing the California test of the fire blocking performance of the mattress that has not been addressed previously. During the test, the flame jet from the side burner impacts the vertical surface of the side border of the mattress and the rising heat and flames tend to concentrate in the indentation between the pillow and the mattress body, causing the underside of the pillow to experience more intense heat and flame than the vertical side of the mattress border, resulting in the failure of the otherwise adequately fire blocked mattress.

What is needed, therefore, is a method of increasing the fire blocking in the gusset between the pillow and mattress to compensate for the more intense flame experience in this area.

SUMMARY OF THE INVENTION

This invention relates to a fire blocked pillow-top mattress comprising a mattress body having a border comprising a first fire blocker, a pillow for said mattress, and a gusset covering the joint between the mattress body and the pillow, wherein the gusset includes a second fire blocker that has a higher basis weight than the first fire blocker.

This invention also relates to a fire blocked pillow-top mattress comprising a mattress body having a border comprising a first fire blocker comprising one or more fabric layers, the first fire blocker having a first thermal performance temperature (TPT); a pillow for said mattress; and a gusset covering the joint between the mattress body and the pillow wherein the gusset includes a second fire blocker comprising one or more layers and having a lower TPT than the first fire blocker.

Another embodiment of this invention relates to a fire blocked pillow-top mattress comprising a mattress body having a seam connecting a panel of the mattress body and a side border, the side border having fire blocking; a pillow having a seamed outer edge; the pillow having a contact point with the mattress body panel inboard from the side border of the mattress body, the seamed outer edge of the pillow also extending outboard above such contact point, wherein the area extending from the seam of the mattress body across the mattress body panel to the pillow contact point and up the underside of the pillow surface to the seamed outer edge of the pillow has more fire blocking than that found in the mattress side border.

This invention further relates to a process for fire blocking a pillow-top mattress comprising a mattress body having a side border and a pillow having a top panel, with a gusset attached to the mattress body and the pillow, comprising the steps of incorporating a first fire blocker into the mattress side border and incorporating a second fire blocker into the gusset, wherein the second fire blocker has either a higher basis weight than the first fire blocker, or a lower TPT than the first fire blocker.

Another embodiment of this invention relates to a process for fire blocking a pillow-top mattress comprising a mattress body having a side border and a pillow having a top panel, with a gusset attached to the mattress body and the pillow, comprising the steps of incorporating a single layer of a fire blocker fabric into the mattress side border and incorporating a plurality of layers of a fire blocker fabric into the gusset.

DETAILS OF THE INVENTION

This invention relates to an improved gusset for use in fire blocking a pillow-top mattress and a fire blocked pillow-top mattress containing this improved gusset. This gusset provides additional fire blocking to provide a pillow-top mattress with improved performance when tested according to Technical Bulletin 603 of the State of California.

Figure 1:
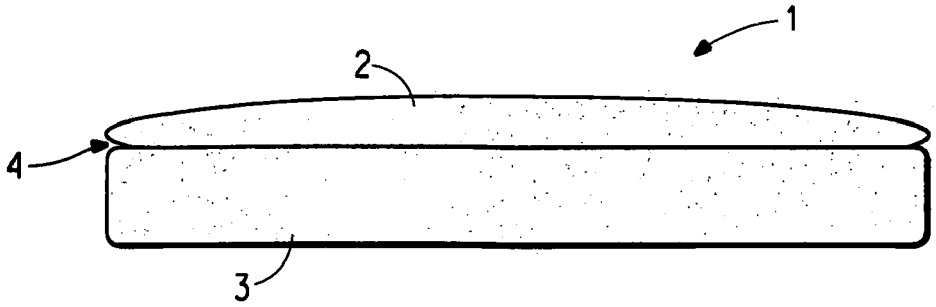
FIG. 1 is a simplified cross-sectional view of a single-sided pillow top mattress.

FIG. 1 illustrates a single-sided pillow-top mattress 1. This mattress is comprised of a pillow 2 attached to a mattress body 3. The pillow typically comprises foam and/or fiber batting, a nonwoven stitch backing, and cover fabric. The mattress body includes mattress internals and coverings. The mattress internals include the mechanical structure of the mattress, such as supporting beams and springs and associated wrappings along with additional foam, or combinations of foams and battings. The mattress internals may also be only foam or other support materials, such as an air or liquid bladder with or without supporting foam, in the place of springs and other mechanical means of support. The coverings for the mattress internals are generally in the form of quilted composites or combinations of quilted composites and additional foam or batting. FIG. 1 also shows an indentation 4 in the side of the mattress at the point where the pillow is attached inboard of the mattress body.

Figure 2:
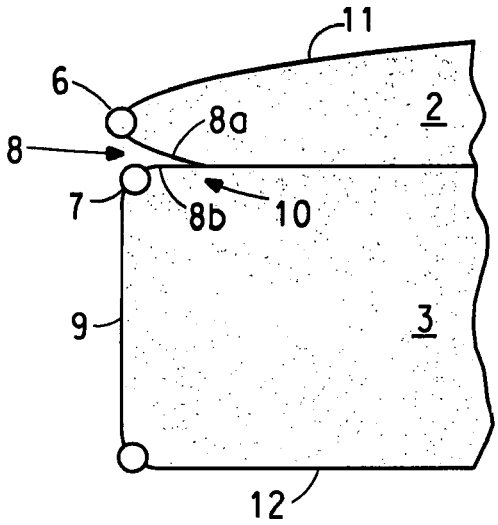
FIG. 2 is a more detailed cross-sectional view of a gusset and border of a single-sided pillow-top mattress.

FIG. 2 illustrates in more detail the indentation area 4 of a single sided pillow top mattress of FIG. 1. A gusset 8 covers the joint 10 between the pillow and the mattress body. The gusset 8 includes an upper gusset surface 8*a* seamed to the pillow at seam 6 and at joint 10; and a lower gusset surface 8*b* seamed to the mattress body at seam 7 and at joint 10. The upper surface 11 of the pillow 2 is referred to as the top panel of the mattress. The top panel 11 is delineated from the upper gusset surface 8*a* by the upper gusset seam 6. The bottom surface 12 of the mattress body 3 is referred to as the bottom panel of the mattress. The vertical surface of the mattress body 9 is referred to as the mattress border. The border 9 is delineated from the lower gusset surface 8*b* by the lower gusset seam, 7.

Fire blocking of the mattress prevents the batting or foam from being ignited, or if the foam is ignited, suppresses the spread of the flame in the supporting foam. In order to prevent the fiber and foam from being ignited, the outer surfaces a mattress that will come in contact with the flame are typically provided with a fire blocker. For the single sided pillow top mattress style, this includes the upper panel 11, the border 9, the gusset 8 and the lower panel 12. In some cases where a tight fit is achieved between mattress and the foundation the lower panel does not require a fire blocker.

A double-sided pillow top mattress is one that comprises two pillows, one attached to the top and bottom panels of the mattress body. In this case, the mattress will have 2 gussets and the outer surfaces of the pillows will form the top and bottom panels of the mattress. In this case it is normally necessary to fire block both upper and lower panels and both upper and lower gussets in addition to the mattress body border.

To quantify the flammability performance of mattress sets the State of California published Technical Bulletin 603 "Requirements and Test Procedure for Resistance of a Residential Mattress/Box Spring Set to a Large Open-Flame". In general, the test protocol utilizes a pair of propane burners to subject the top panel and one side border of a mattress or mattress/foundation set to high heat flux in the form of flame jets. It is more difficult for a pillow top mattress to past the test than a non-pillow top mattress, because during the test, the flame jet from the side burner impacts the border 9 of the mattress and the rising heat and flames tend to concentrate in the gusset area, and it is believed this causes the underside of the pillow in the indentation (gusset area 8*a*) to experience a more intense flame experience than the border 9 of the mattress, which typically results in the failure of the otherwise adequately fire blocked mattress.

It is thought the more intense flame experience in the gusset is due to not only the flames impinging the area from the side burner jet but also from the upward flames generated from the burning of the border, causing the material in the gusset area 8*b* to also burn and in turn impinge on the underside of gusset area 8*a*.

Figure 3:
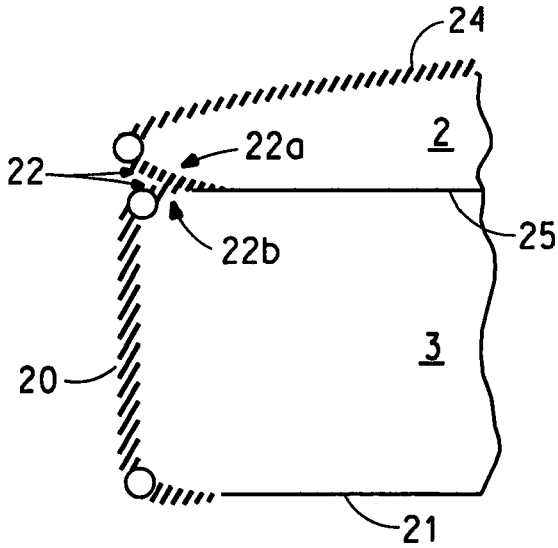
FIG. 3 is a detailed cross-sectional view of a single-sided pillow-top mattress showing the placement of fire blocking quilted composites.

The outer surfaces of mattresses, that is, the gussets, borders and panels, are typically a layer of pre-stitched quilted composite materials comprising a cover fabric, fiber and/or foam and a stitch backing. In a fire blocked mattress, the quilted composite material described above will preferably contain one or more layers of a fire blocker. Referring to FIG. 3, single-sided pillow-top mattress having a pillow 2 is shown attached to a mattress body 3. In a typical construction of this invention, mattress body 3 is provided with a fire blocking quilted composite 20 on the border and optionally fire blocking quilted composite 21 on the bottom panel. Quilted composites 20 and 21 may be the same or different. The gusset between the mattress body and the pillow is provided with fire blocking quilted composite 22, with the upper gusset surface 22*a* attached to the pillow and lower gusset surface 22*b* attached to the mattress body. The pillow 2 is provided with fire blocking quilted composite 24 over its top panel. Note that the internal contact area 25 between the pillow and the mattress body typically is not provided with a fire blocking quilted composite, and is generally not needed. However, one may be added there if desired.

Figure 4A:
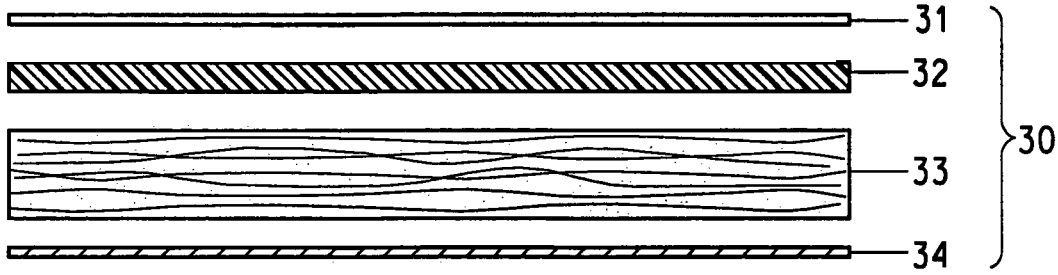
FIGS. 4A, 4B, and 4C illustrate examples of the layering of quilted composites incorporating fire blockers, expanded for clarity.

The pre-stitched quilted composites can be in have many forms. A basic example of a quilted composite is shown in FIG. 4A. Quilted composite 30 is shown comprising an outer fabric ticking or cover fabric layer 31, a fire blocker 32, a cushioning layer of foam or fiber batting 33, and a stitch-backing layer 34. Fabrics useful as the outer fabric ticking or cover fabric layer 31 are normally very durable woven or knit fabrics utilizing any number of weaves, and tend to have basis weights in the range of 2 to 8 ounces per square yard (68 to 271 grams per square meter). Ticking fabrics may contain but are not limited to cotton, polyester fibers, polypropylene fibers, or rayon fibers.

The fire blocker 32 is preferably a single layer nonwoven sheet comprised of at least 0.5 ounces per square yard (17 grams per square meter) of a cellulose fiber that retains at least 10 percent of its fiber weight when heated in air to 700° C. at a rate of 20 degrees C. per minute, and at least 0.5 ounces per square yard (17 grams per square meter) of heat resistant fiber. The nonwoven fire-blocking sheet preferably has a basis weight of at least 2.5 ounces per square yard (85 grams per square meter). Single layer nonwoven sheets having basis weights of less than that amount do not provide adequate fire-blocking performance. The maximum practical basis weight of a single layer nonwoven fire-blocking sheet is in the range of 7 ounces per square yard. Heavier weight fabrics still provide protection, however, with additional basis weight there is little improvement in fire retarding performance.

The nonwoven fire-blocking sheet can be made by conventional nonwoven sheet forming processes, including processes for making air-laid nonwovens or wet-laid nonwovens, and such formed sheets can be consolidated via spunlacing, hydrolacing, needlepunching, or other processes which can generate a nonwoven sheet. The spunlaced processes disclosed in U.S. Pat. Nos. 3,508,308 and 3,797,074; and the needlepunching processes disclosed in U.S. Pat. Nos. 2,910,763 and 3,684,284 are examples of methods well known in the art that are useful in the manufacture of the nonwoven fabrics. The preferred nonwoven sheets used in this invention are air-laid spunlaced or hydrolaced nonwovens where high pressure water jets are used to entangle fibers into a cohesive sheet.

The cellulose fiber preferably used in the fire-blocking sheet is a char-forming cellulose fiber. By char-forming, it is meant the cellulose fiber retains at least 10 percent of its weight when heated in air to 700° C. at a rate of 20 degrees C. per minute. Such cellulose fibers preferably have equal to or greater than 10 percent inorganic compounds incorporated into the fibers. Such fibers, and methods for making such fibers, are generally disclosed in U.S. Pat. No. 3,565,749 and British Pat. No. GB 1,064,271. A preferred char-forming cellulose fiber for this invention is a viscose fiber containing hydrated silicon dioxide in the form of a polysilicic acid with aluminum silicate sites. Such fibers, and methods for making such fibers are generally disclosed in U.S. Pat. No. 5,417,752 and PCT Pat. Appl. WO9217629. Viscose fiber containing silicic acid and having approximately 31 (+/−3) percent inorganic material is sold under the trademark Visil® by Sateri Oy Company of Finland. These char-forming fibers, when incorporated into the nonwoven sheet, provide adequate fire-blocking performance without the need for the fabric to be treated with additional flame-retardant additives or topically-applied flame retardant compounds.

The heat resistant fiber is preferably an organic fiber, and by "heat resistant" it is meant that the fiber preferably retains 90 percent of its fiber weight when heated in air to 500° C. at a rate of 20 degrees C. per minute. Such fibers are normally flame resistant, meaning the fiber or a fabric made from the fiber has a Limiting Oxygen Index (LOI) such that the fiber or fabric will not support a flame in air, the preferred LOI range being greater than 26. The preferred fibers do not excessively shrink when exposed to a flame, that is, the length of the fiber will not significantly shorten when exposed to flame. Sheets containing 0.5 ounces per square yard (17 grams per square meter) of an organic fiber that retains 90 percent of its fiber weight when heated in air to 500° C. at a rate of 20 degrees C. per minute tend to have limited amount of cracks and openings when burned by an impinging flame.

Heat resistant and stable fibers useful in the nonwoven fire-blocking sheets of this invention include fiber made from para-aramid, polybenzazole, polybenzimidazole, and polyimide polymer. The preferred heat resistant fiber is made from para-aramid polymer.

As used herein, "aramid" is meant a polyamide wherein at least 85% of the amide (—CONH—) linkages are attached directly to two aromatic rings. Additives can be used with the aramid. In fact, it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. In the practice of this invention, the preferred para-aramid is poly(paraphenylene terephthalamide). Methods for making para-aramid fibers useful in this invention are generally disclosed in, for example, U.S. Pat. Nos. 3,869,430; 3,869,429; and 3,767,756. Such aromatic polyamide organic fibers and various forms of these fibers are available from DuPont Company, Wilmington, Del. under the trademark Kevlar® fibers.

Commercially available polybenzazole fibers useful in this invention include Zylon® PBO-AS (Poly(p-phenylene-2,6-benzobisoxazole) fiber, Zylon® PBO-HM (Poly(p-phenylene-2,6-benzobisoxazole)) fiber, available from Toyobo, Japan. Commercially available polybenzimidazole fibers useful in this invention include PBI® fiber available from Celanese Acetate LLC. Commercially available polyimide fibers useful in this invention include P-84® fiber available from LaPlace Chemical.

The nonwoven sheets used in the fire blocker can include, in addition, an off gassing material that releases a flame suppressing gas when burned. The preferred off gassing material are fibers made from halogen-containing polymers, such as modacrylic fiber or polyvinylchloride fibers. These polymers release chlorine-containing gases when burned. Up to 4 ounces per square yard (136 grams per square meter) of such materials can be added to the single layer nonwoven fabric. Useful modacrylic fibers include, but are not limited to, those disclosed in U.S. Pat. No. 5,506,042.

The cushioning layer of foam or fiber batting 33 may include one or more light density fibrous batting or foams, or a combination thereof that provide the surface effect that is highly desired by the consumer. The batting and/or foams acts like a pillow underneath the ticking, providing very tactile cushioning, the type that can be readily discerned by simply touching or running one's hand across the mattress. The preferred fibrous batting material is polyester (PET) batting and is typically present in an amount of about 0.5 to 2.0 ounces per square yard (17 to 68 grams/square meter). While not intended to be limiting, if the cushioning material is a fibrous batting, such batting may include a vertically pleated structure such as disclosed in, for example, in PCT Publication WO2003049581 or a batting of fibers such as disclosed for example in U.S. Pat. No. 3,118,750. If foam is used, it is commonly polyurethane or latex foam and is generally about 1 to 3 inches thick.

The quilted composite illustrated in FIG. 4A also has a stitch backing layer 34, which is a fabric layer used to hold the stitch on the side opposite the ticking. Typically, stitch backing layers are typically lightweight fabrics made from polypropylene and having a basis weight in the range of 0.5 ounces per square yard (17 grams per square meter). The layers shown in FIG. 4A are combined and then stitched together using any common stitch pattern, typically a quilting pattern, to form a quilted composite structure that is then seamed together to cover the mattress border, panels, or gussets as needed.

Figure 4B:
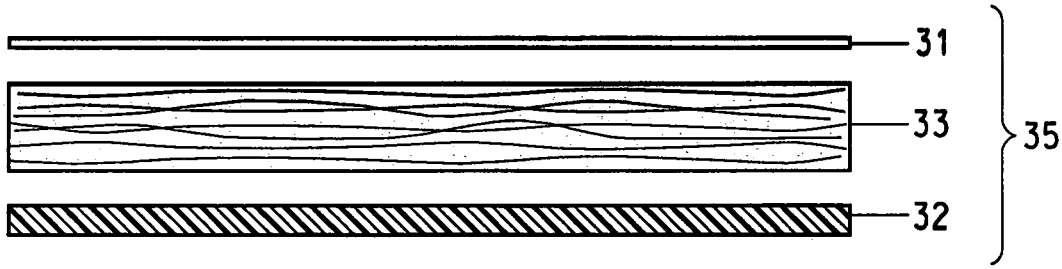
Figure 4C:
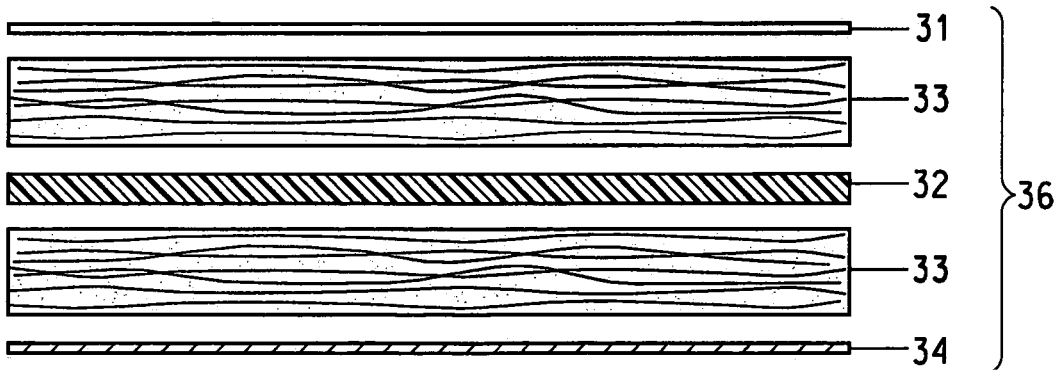

While not intended to be limiting, there are many alternative fire blocking quilted composites useful in this invention. FIG. 4B illustrates and alternative quilted composite 35 having the combination of ticking 31, cushioning material 33, and fire blocker 32 wherein the cushioning material is sandwiched between the fire blocker and the ticking. In this quilted composite, no stitch backing is needed because the fire blocker serves the purpose of holding the stitch. FIG. 4C illustrates a possible fire blocking quilted composite 36 having additional cushioning material. The quilted composite is formed by combining, in order, ticking fabric 31, a layer of cushioning material 33, a fire blocker 32, another layer of cushioning material 33, and a stitch backing layer 34.

Figure 5A:
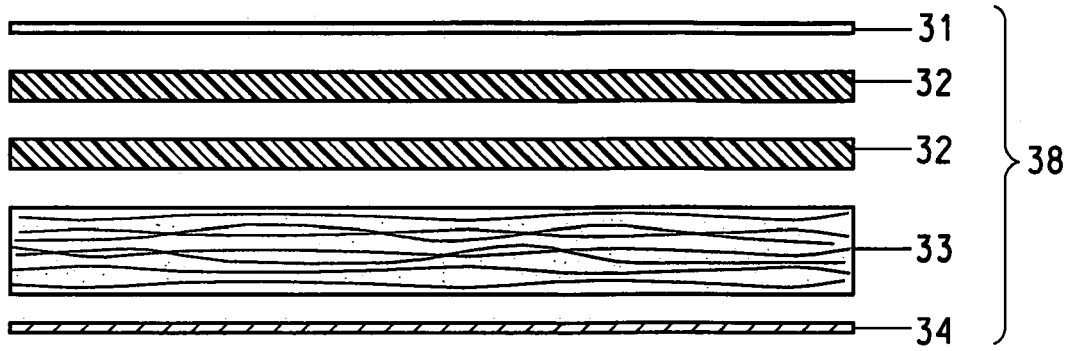
FIGS. 5A, 5B, 5C, 5D, and 5E illustrate examples of the layering of quilted composites incorporating two fire blocking layers, expanded for clarity.
Figure 5B:
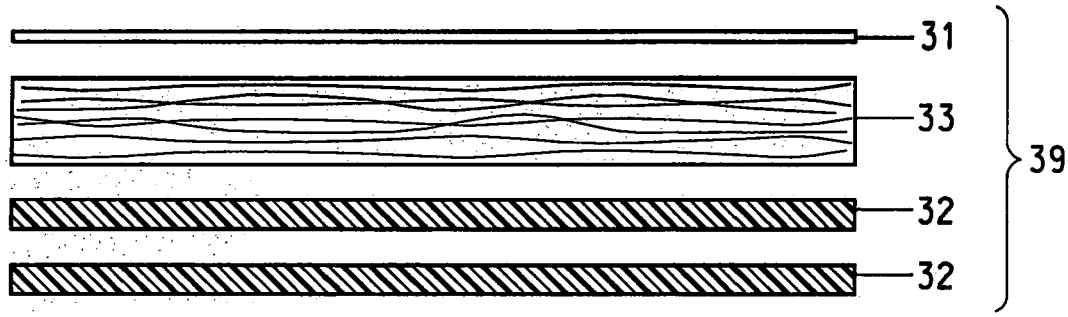
Figure 5C:
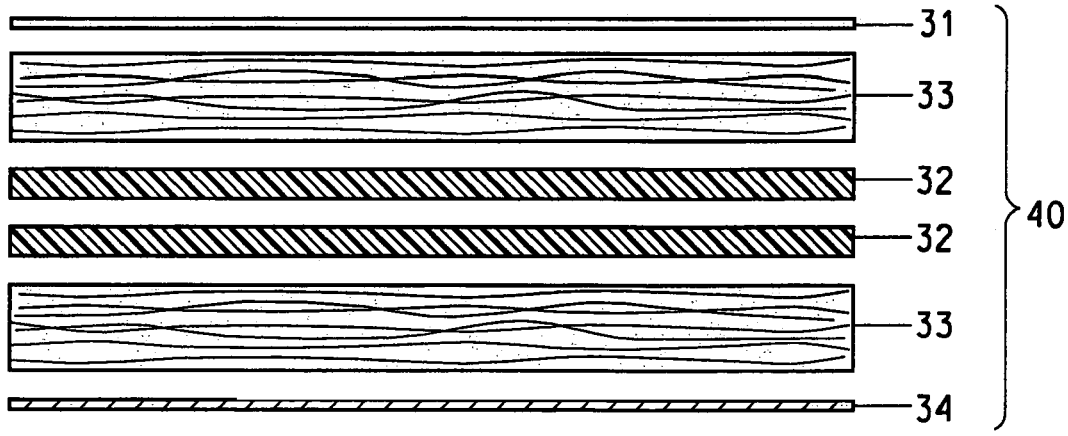
Figure 5D:
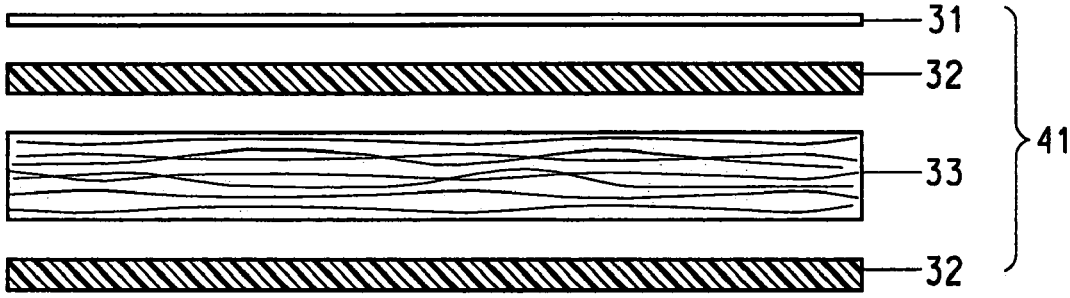
Figure 5E:
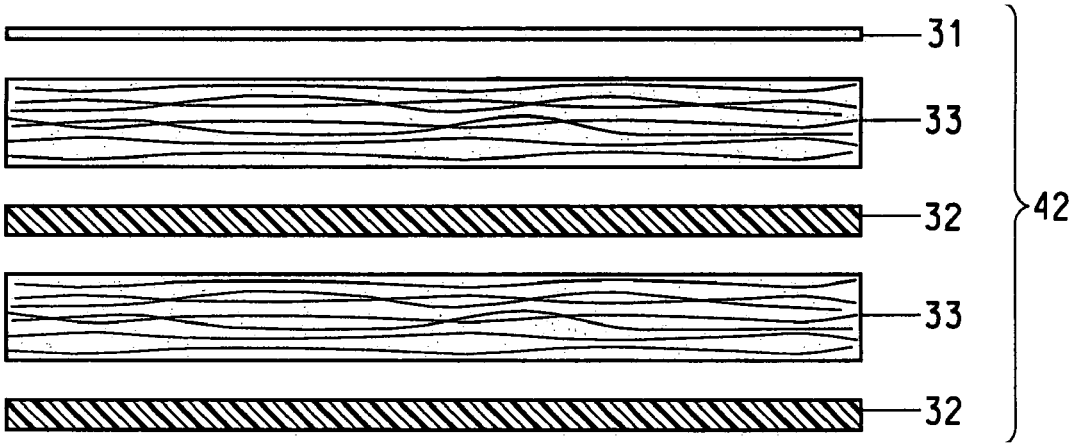
Figure 6:
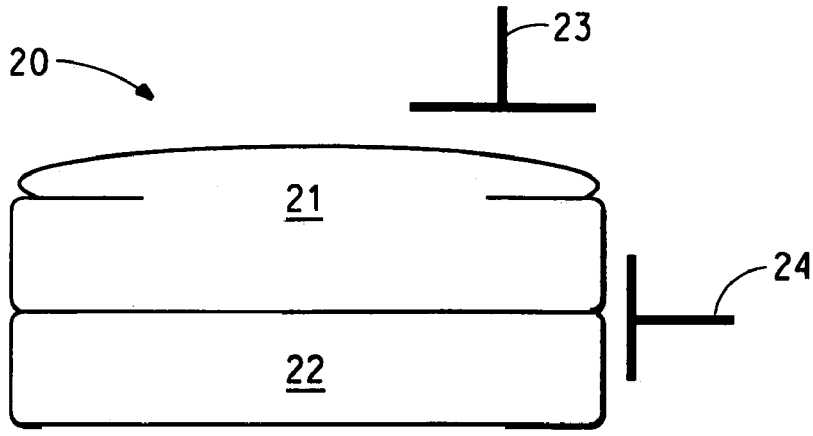
FIG. 6 illustrates, in a simplified manner, the arrangement of burners, and a single-sided pillow top mattress and foundation used to test the burn performance of a mattress set containing the gusset of this invention.

The fire blocker used in these fire-blocking quilted composites can include multiple layers of fire blocking material. For example, FIG. 5A illustrates quilted composite 38 that is similar to quilted composite 30 shown in FIG. 4A, except the fire blocker 32 is comprised of two layers of material. Likewise, FIG. 5B illustrates quilted composite 39 and FIG. 5C illustrates quilted composite 40, which are similar to quilted composites 35 and 36 of FIGS. 4B and 4C, respectively, except that the fire blocker 32 is comprised of two layers of material. It is not necessary that the fire blocking layers be placed together. FIG. 5D shows a possible quilted composite configuration 41 in which one upper fire blocking layer 32 is directly under the cover fabric 31 and the second lower fire blocking layer 32, functioning as a stitch backing, is under a cushioning layer 33. FIG. 5E shows a quilted composite configuration 42 similar to 41 with the addition that another cushioning layer 33 is added between the cover fabric 31 and the upper fire blocking layer 32.

One embodiment of the fire blocked pillow-top mattress of this invention comprises a mattress body having a border comprising a first fire blocker, a pillow for said mattress, and a gusset covering the joint between the mattress body and the pillow, wherein the gusset includes a second fire blocker that has a higher basis weight than the first fire blocker. The second fire blocker is generally at least 20 percent higher in basis weight, and preferably at least 50 percent higher in basis weight. The composition of the second fire blocker can be the same or different from the first fire blocker. The top panel of the pillow is also preferably fire blocked with a quilted composite containing a suitable fire blocker. The gusset having the increased basis weight provides sufficient fire resistance to the gusset area to allow the mattress to pass when tested according to Technical Bulletin 603 of the State of California.

Another embodiment of the fire blocked pillow-top mattress of this invention comprises a mattress body having a border comprising a first fire blocker comprising one or more fabric layers, the first fire blocker having a first TPT; a pillow for said mattress; and a gusset covering the joint between the mattress body and the pillow wherein the gusset includes a second fire blocker comprising one or more layers and having a lower TPT than the first fire blocker. Preferably, the second fire blocker has a TPT that is at least 50 degrees Celsius lower, and the composition of the second fire blocker can be the same or different from the first fire blocker. The top panel of the pillow is preferably fire blocked with a quilted composite containing a suitable fire blocker.

Thermal performance, as used herein, is characterized by the TPT of the fabric, which is a value that is directly proportional to the amount of heat that passes through the barrier fabric. Low TPT values mean the fire blocker is a good insulator from flame and will help prevent the internals of a mattress from the heat from an external flame.

The TPT can be reduced in any number of ways. If the fabric composition is not changed, the TPT can be reduced by increasing the basis weight of the fabric, or by combining two or more sheets of fire blocking material. Conversely, the fabric used in the gusset area can be different from that used in the border, and, depending on the composition, may be the same, or heavier or lighter in basis weight to the fire blocker in the border. A third possible method of reducing the TPT can be achieved by changing the structure of the fire blocker, that is, by reducing the volumetric density, weaving or knitting the fire blocking sheets versus using nonwoven sheets, or combining woven or knitting sheets with nonwoven sheets, or using specialty weaves and the like, that through testing have shown can decrease the TPT. A fourth method of reducing the TPT is through the use of coatings or additives that would increase the flame retardancy of the fire blocker used in the gusset. Specifically, intumescent coatings or fire blocking coatings such as Thermolose may be used.

The preferred fire blocked mattress contains a border having a quilted composite containing, as a first fire blocker, one layer of a nonwoven fire-resistant fabric and a gusset having a quilted composite containing, as a second fire blocker, two layers of that same nonwoven fire-resistant fabric. This eliminates the need for two types of fire blocker fabric compositions and allows one to easily check that the gusset has additional fire blocking by the presence of two layers.

This gusset provides additional fire blocking to provide a pillow-top mattress with improved performance when tested according to Technical Bulletin 603 of the State of California.

Another embodiment of the fire blocked pillow-top mattress of this invention comprises a mattress body having a seam connecting a panel of the mattress body and a side border, the side border having fire blocking; an attached pillow having a seamed outer edge, said pillow having a contact point with the mattress inboard from the side border of the mattress, the seamed outer edge of said pillow also extending outboard above such contact point and the area extending from the seam of the mattress body across the mattress body panel to the pillow contact point and up the underside of the pillow surface to the seamed outer edge of the pillow having more fire blocking than that found in the mattress side border. "More fire blocking" can include the concepts previously mentioned, including having more fire blocking material in the gusset area, or providing the gusset area with fire blocking material having a lower TPT than the border fire blocking material. Preferably the top panel of the pillow is also fire blocked with a quilted composite containing a nonwoven fabric fire blocker.

This invention further relates to a process for fire blocking a pillow-top mattress comprising a mattress body having a side border and a pillow having a top panel, with a gusset covering the joint between the mattress body and the pillow, comprising the steps of incorporating a first fire blocker into the mattress side border and incorporating a second fire blocker into the gusset, wherein the second fire blocker has either a higher basis weight than the first fire blocker, or a lower TPT than the first fire blocker. The top panel of the pillow is preferably fire blocked with a quilted composite containing either the first or second fire blocker. Preferably the first and second fire blockers are nonwoven fabrics.

Another embodiment of this invention relates to a process for fire blocking a pillow-top mattress comprising a mattress body having a side border and a pillow having a top panel, with a gusset covering the joint between the mattress body and the pillow, comprising the steps of incorporating a single layer of a fire blocker fabric into the mattress side border and incorporating a plurality of layers of a fire blocker fabric into the gusset. The fire blocker fabric used in the border and the gusset are preferably the same fabric.

Test Methods

Mattress Burn Performance. The Bureau of Home Furnishings and Thermal Insulation of the Department of Consumer Affairs of the State of California (3485 Orange Grove Avenue, North Highlands, Calif. 95660-5595, USA) published Technical Bulletin 603 "Requirements and Test Procedure for Resistance of a Residential Mattress/Box Spring Set to a Large Open-Flame" dated November 2003 to quantify the flammability performance of mattress sets. This protocol provides a means of determining the burning behavior of mattress/foundation sets by measuring specific fire test responses when the mattress plus foundation are exposed to a specified flaming ignition source under well-ventilated conditions. It is based on the National Institute of Standards and Technology Publication titled "Protocol of Testing Mattress/Foundation Sets Using a Pair of Gas Burners" dated February 2003.

Test data are obtained that describe the burning during and subsequent to the application of a specific pair of gas burners from the point of ignition until (1) all burning of the sleep set has stopped, (2) a period of one hour has elapsed, or (3) flashover of the test room appears inevitable. The rate of heat release from the burning test specimen (the energy generated by the fire) is measured by oxygen consumption calorimetry. A discussion of the principles, limitations, and requisite instrumentation are found in ASTM E 1590 "Standard Test Method of Fire Testing of Mattresses". Terminology associated with the testing is defined in ASTM E 176 "Standard Terminology of Fire Standards".

In general, the test protocol utilizes a pair of propane burners, designed to mimic the heat flux levels and durations imposed on a mattress and foundation by burning bedclothes. The burners impose differing fluxes for differing times on the mattress top and the side of the mattress/foundation. During and subsequent to this exposure, measurements are made of the time-dependent heat release rate from the test specimen.

The mattress/foundation is placed on top of a short bed frame that sits on a catch surface. During the testing, the smoke plume is caught by a hood that is instrumented to measure heat release rate. For practicality, twin-sized mattresses and foundations are tested. After ignition by the burners, the specimen is allowed to burn freely under well-ventilated conditions.

Figure 7:
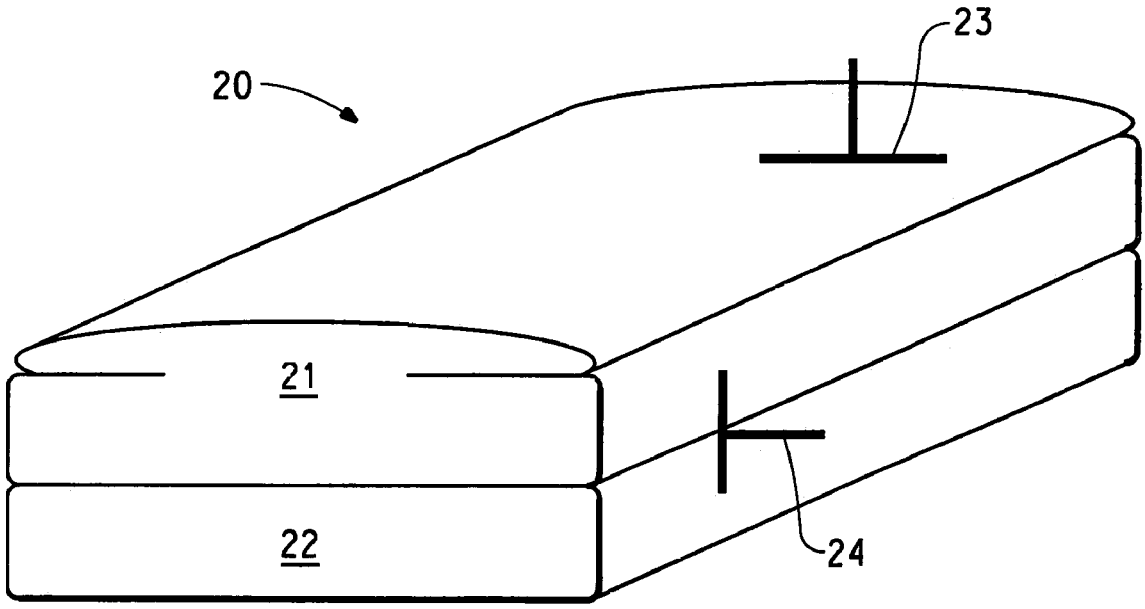
FIG. 7 illustrates, in a simplified manner, the offset of the arrangement of burners used to burn the single-sided pillow top mattress set containing the gusset of this invention.

A representative illustration of the general locations of the gas burners, not drawn to scale, is shown in FIG. 7. Test specimen 20 includes a pillow top mattress 21 is placed on foundation 22 with T-shaped burners 23 and 24 set to burn the specimen. Burner 23 impinges flames on the top surface of the mattress and is set 39 mm from the surface of the mattress. The second burner 24 impinges flames vertically on the side of the mattress/foundation combination and is set 42 mm from the side of the specimen. The side burner and the top burner are not set at the same place along the length of the specimen but are offset from on another along the length approximately 18 to 20 cm as generally illustrated in FIG. 8. The burners are specially constructed and aligned per the test method.

The test specimen is conditioned for 24 hours prior to the testing at an ambient temperature of above 12 Celsius (54 Fahrenheit) and a relative humidity of less than 70 percent. The test specimen of mattress and foundation is centered on each other and the frame and catch surface. If the mattress is 1 to 2 cm narrower than the foundation the mattress may be shifted until the sides of the mattress and foundation are aligned vertically. The burners are aligned and spaced from the specimen per the standard. Data recording and logging devices are turned on at least one minute prior to ignition. The burners are ignited and the top burner is allowed to burn for 70 seconds while the side burner is allowed to burn for 50 seconds and then they are removed from the area. Data collection continues until all signs of burning and smoldering have ceased or until one hour has elapsed.

ThermoGravametric Analysis. The fibers used in this invention retain a portion of their fiber weight when heated to high temperature at a specific heating rate. This fiber weight was measured using a Model 2950 Thermogravimetric Analyzer (TGA) available from TA Instruments (a division of Waters Corporation) of Newark, Del. The TGA gives a scan of sample weight loss versus increasing temperature. Using the TA Universal Analysis program, percent weight loss can be measured at any recorded temperature. The program profile consists of equilibrating the sample at 50 degrees C.; ramping the temperature at from 10 or 20 degrees C. per minute from 50 to 1000 degrees C.; using air as the gas, supplied at 10 ml/minute; and using a 500 microliter ceramic cup (PN 952018.910) sample container.

The testing procedure is as follows. The TGA was programmed using the TGA screen on the TA Systems 2900 Controller. The sample ID was entered and the planned temperature ramp program of 20 degrees per minute selected. The empty sample cup was tared using the tare function of the instrument. The fiber sample was cut into approximately 1/16" (0.16 cm) lengths and the sample pan was loosely filled with the sample. The sample weight should be in the range of 10 to 50 mg. The TGA has a balance, therefore the exact weight does not have to be determined beforehand. None of the sample should be outside the pan. The filled sample pan was loaded onto the balance wire making sure the thermocouple is close to the top edge of the pan but not touching it. The furnace is raised over the pan and the TGA is started. Once the program is complete, the TGA will automatically lower the furnace, remove the sample pan, and go into a cool down mode. The TA Systems 2900 Universal Analysis program is then used to analyze and produce the TGA scan for percent weight loss over the range of temperatures.

Thermal Performance Temperature. The thermal insulating properties of these fabrics at high temperatures and heat fluxes was measured using the same instrument that is used for the NFPA1971 Standard on Protective Ensemble for Structural Fire Fighting 2000 Edition Section 6-10. In order to characterize the materials of this invention, the instrument was operated in a data acquisition mode. A 2 cal/cm$^2$/second (8.38 J/cm$^2$/second) heat flux was imposed on the fabric for 90 seconds. During this time, the heat passing through the materials was measured using a calorimeter placed in direct contact with the back face (base layer) of the specimen. The materials were characterized in terms of the temperature of the calorimeter thermocouple at the end of the 90 seconds exposure. This value is directly proportional to the amount of heat that passed through the barrier fabric.

Basis Weight. Basis weight of the batting was measured using ASTM D6242-98.

Thickness. Thickness of the layered batting was measured using ASTM D5736-95 (Reapproved 2001).

EXAMPLE

Three sleep sets, each comprised of a pillow top mattress and foundation, were made using typical mattress and box spring construction techniques, each set only differing in the level of fire-blocking fabric used in the gusset.

The foundation was a standard steel coil and wood box construction. The mattress body was a standard steel coil construction covered with a fiber pad and a 0.5-inch (1.25 centimeter) foam sheet.

Panel material for the mattresses was assembled by quilting together with standard polyester thread the following components in the order: 3.5 ounces per square yard (119 grams per square meter) woven polyester/propylene blend ticking fabric, a single layer of fire blocking fabric "A" from Table 1, approximately 0.75 inch (1.91 cm) polyester batting having an basis weight of 0.75 ounces per square yard (25 grams per square meter), three 0.5 inch (1.25 cm) polyurethane foam sheets, and a nonwoven backing sheet of approximately 1 ounces per square yard (34 grams per square meter). This panel material was used to cover the top panel of the pillow.

TABLE 1

| Fire Blocking Fabric Identification | Description |
|---|---|
| A | 2.5 ounces per square yard (85 grams per square meter) spunlaced nonwoven fabric having a composition of 50% Kevlar ® brand aramid fiber and 50% Visil ® FR viscose fiber onto which 4.0 ounces per square yard (136 grams per square meter) have been needled felted having a composition of 67% Protex C modacrylic fiber and 33% Visil ® FR viscose fiber |
| B | 3.0 ounces per square yard (102 grams per square meter) spunlaced nonwoven fabric 100% having a composition of 100% Kevlar ® aramid fiber |
| C | 4.5 ounces per square yard (153 grams per square meter) spunlaced nonwoven fabric having a composition of 25% Kevlar ® aramid fiber, 25% Nomex ® aramid fiber and 50% Protex C modacrylic fiber. |

Border material was assembled in a separate operation by quilting together with standard polyester thread the following components in the order: 3.5 ounces per square yard (119 grams per square meter) woven polyester/polypropylene blend ticking fabric, a single layer of the same fire blocking fabric "A" from Table 1, approximately 0.375" polyurethane foam having an basis weight of 2.5 ounces per square yard (85 grams per square meter) and a nonwoven backing sheet of approximately 1 ounces per square yard. The border material was used to cover all four borders (vertical sides) of the mattresses. The same border material described above was also used on the four vertical sides of the foundation employing a 2 inch (5.1 centimeter) continental or waterfall design on the upper edge of the foundation, a design in which the border material is folded over the upper edge and extends onto the foundation top panel.

The foundation top panel area within the continental edge was covered with a 4 ounces per square yard (136 grams per square meter) of spunlaced nonwoven fabric (having a composition of 25% Kevlar® aramid fiber and 75% Visil® FR viscose) under a standard non-skid pad. All border and panel composite material seams were sewed with a thread containing Kevlar® aramid fiber. FR-treated polyester seam tape was also used throughout.

In order to form the material used for the gusset, an additional layer of fire blocking fabric "B" or "C" from Table 1 was serged onto the back of the same border material used in the foundation and mattress borders and described above such that the added blocking fabric was in contact with the 1 ounces per square yard (34 grams per square meter) backing sheet.

The TPT of the fire blockers was measured. The results are shown in Table 2.

TABLE 2

| Fire Blocking Fabric Identification | TPT, ° C. |
|---|---|
| A | 346 |
| B | 409 |
| C | 429 |

The three sleep sets were individually burned according to Technical Bulletin 603 of the State of California. Burn results are summarized in Table 3. The set without any additional fire blocker in the gusset (Example 1) exceeded 150 kW heat release rate in 27 minutes. The sets that had additional fire blocking in the gusset did not exceed 150 kW through the entire 60 minutes that the heat release rate was monitored.

TABLE 3

| Example | Fire blocker in gusset | Time to exceed 150 kW heat release rate |
|---|---|---|
| 1 (comparative) | A | 27 minutes |
| 2 | A plus B (see Table 1) | Did Not |
| 3 | A plus C (see Table 1) | Did Not |

PHRR = Peak Heat Release Rate
THR = Total Heat Release

For the examples shown above, the TPT of the gusset was reduced by using an additional layer of a second fire blocking fabric. It would have been possible to obtain the same result by using two layers of fire blocking fabric "A". Another method of increasing the TPT is to use a fabric of high basis weight. The fact that the TPT decreases with basis weight is shown clear by the following series of spunlaced fabrics composed of approximately 25% Kevlar® aramid fiber, 42% Visil® FR and 33% Protex C modacrylic fiber. Within this series the TPP rating increases approximately proportionately with the basis weight.

| Example | Basis weight, ounces per square yard (grams per square meter) | TPT, ° C. |
|---|---|---|
| 4 | 2.5 (85) | 471 |
| 5 | 3.8 (129) | 434 |
| 6 | 5.0 (169) | 393 |
| 7 | 6.5 (220) | 346 |

What is claimed is:

1. A fire blocked pillow-top mattress, comprising:

a) a mattress body having a border comprising a quilted composite comprising ticking, a first fire blocker comprising one or more fabric layers, and cushioning material, the first fire blocker having a first thermal performance temperature, b) a pillow for said mattress, and c) a gusset covering a joint between the mattress body and the pillow, wherein the gusset includes a quilted composite comprising ticking, a second fire blocker comprising one or more layers, and cushioning material, the second fire blocker having a lower thermal performance temperature than the first fire blocker.

2. The fire blocked mattress of claim 1 wherein the pillow also comprises a fire blocker.

3. The fire blocked mattress of claim 1 wherein the pillow is fire blocked with a quilted composite comprising ticking, the first fire blocker, and cushioning material.

4. The fire blocked mattress of claim 1 wherein the gusset is attached to the mattress body and pillow by sewing.

5. The fire blocked mattress of claim 1 wherein the first or second fire blocker comprises a nonwoven fabric.

6. The fire blocked mattress of claim 1 wherein the first fire blocker comprises one layer of a nonwoven fabric and the second fire blocker comprises two layers of the same nonwoven fabric.

7. A process for fire blocking a pillow-top mattress comprising a mattress body having a side border and a pillow having a top panel, with a gusset covering a joint between the mattress body and the pillow, comprising the steps of:

a) incorporating a quilted composite comprising ticking, a first fire blocker, and cushioning material into the mattress side border, and b) incorporating a quilted composite comprising ticking, a second fire blocker, and cushioning material into the gusset, wherein the second fire blocker has a lower thermal performance temperature than the first fire blocker.

8. The process of claim 7 wherein the top panel of the pillow is also fire blocked with a quilted composite comprising ticking, either the first or second fire blocker, and cushioning material.

9. The process of claim 7 wherein the first or second fire blocker is a nonwoven fabric.

* * * * *